US012150507B1

(12) United States Patent
Montes

(10) Patent No.: US 12,150,507 B1
(45) Date of Patent: Nov. 26, 2024

(54) LACE-CONVERTER STRAP SYSTEM AND DUAL MATERIAL HANDWRAP

(71) Applicant: 171 Studios, LLC, Boston, MA (US)

(72) Inventor: Rafael Montes, Boston, MA (US)

( * ) Notice: Subject to any disclaimer, the term of this patent is extended or adjusted under 35 U.S.C. 154(b) by 56 days.

(21) Appl. No.: 17/701,947

(22) Filed: Mar. 23, 2022

Related U.S. Application Data

(60) Provisional application No. 63/164,790, filed on Mar. 23, 2021.

(51) Int. Cl.
*A41F 1/06* (2006.01)
*A63B 71/14* (2006.01)

(52) U.S. Cl.
CPC ..... *A41F 1/06* (2013.01); *A63B 71/145* (2013.01)

(58) Field of Classification Search
CPC ..... A41F 1/06; A63B 71/145
See application file for complete search history.

(56) References Cited

U.S. PATENT DOCUMENTS 4,414,761 A * 11/1983 Mahood ..... A43C 1/00 24/712
5,353,483 A * 10/1994 Louviere ..... A43C 11/1493 24/712.1
5,357,691 A * 10/1994 Hyde ..... A43B 23/26 36/50.1
5,907,912 A * 6/1999 Alaimo ..... A43C 11/008 36/50.1
6,295,704 B1 * 10/2001 Rivas ..... A43C 7/06 24/712.9
6,568,104 B2 * 5/2003 Liu ..... A43C 11/008 24/712
10,912,985 B2 * 2/2021 Barton ..... A63B 71/145
11,388,956 B2 * 7/2022 Hatfield ..... A43C 1/06
2004/0006856 A1 * 1/2004 Moreno ..... A43C 7/02 24/306
2017/0231326 A1 * 8/2017 Fisher ..... A43C 11/008 24/68 SK
2017/0282048 A1 * 10/2017 Wittman ..... A63B 71/145
2018/0369679 A1 * 12/2018 Barton ..... A63B 71/145

* cited by examiner

*Primary Examiner* — David M Upchurch
(74) *Attorney, Agent, or Firm* — Giordano Law LLC; David A. Giordano

(57) ABSTRACT

A lace converter strap system, dual material handwrap, and non-stretch non-slip tape alternative are disclosed for use in various articles of clothing including combat sport gloves, footwear, and other body-worn equipment. The system and dual material handwrap addresses the requirement of dexterity, creates a wider range of closure, and is much faster for controlling distribution of load along material than traditional lacing. The system and dual material handwrap also releases significantly faster than a typical laced article. The system is easily adjustable and can be set to ideal open/close positions by the user. By combining a tacky non-slip silicone coating to a non-stretch woven ribbon, the various aspects of the invention provide a reusable tape-alternative in closing laces for articles and supporting parts of the body.

4 Claims, 10 Drawing Sheets

LACE-CONVERTER STRAP SYSTEM AND DUAL MATERIAL HANDWRAP

FIELD

This application generally relates to products that require a tacky, tape-like application to aid in closure for a gap or overlap created when the product is in an "open" position, or in wrapping of body parts for protection and support during sports or activities. Particularly, this disclosure relates to products that are laced, such as footwear, body-worn equipment, gloves for fighting sports, medical or supporting braces for wrapping of joints or other body parts.

BACKGROUND

Currently, lacing systems for gloves or footwear provide support and closure. However, lacing systems are limited by a user's dexterity and the amount that an apparatus can close, i.e., the distance traveled by the system to close the opening. Further, current lacing systems are also time consuming both when tightening and loosening to release the enclosed object or body part.

Proper lacing and distributing load along materials requires dexterity of fingers from both hands. Currently, existing lacing systems also limit the closure of materials. The standard "Criss-Cross" lace does not allow the article to close completely because the lace itself occupies the space. The "Bow-Tie" lace allows the material to close a gap, but distorts the material once passed its threshold for closure.

Further, lacing is time consuming, which may cause negative effects depending on the circumstance. For example, in emergency situations, first responders are often required to lace up protective gear before proceeding to an emergency call. As another example, when a user laces a boxing glove, the user needs a second person to lace the second glove because the user's first hand is now gloved. This is time consuming and requires the aid of a second person. Even further, there can be a need to quickly remove boxing gloves to assess injuries under the glove and to enable use of the user's fingers. This is also time consuming and often requires the aid of another person.

There is a need for improved lacing systems that are easier to use, increase closure, provide support, and are less time consuming to use.

Related to lacing issues are associated gauze and taping solutions for supporting personal injuries. For example, supporting the hand for combat sport competition is typically done using gauze and athletic tape because of its supportive properties. Unfortunately, the combination of gauze and tape can only be used once and requires the expertise of a trained expert to apply to a user's hands because a user cannot apply the combination alone. Furthermore, official combat sports regulations often require that tape not touch the skin, and that tape across the hand cannot be closer than one inch from the knuckles.

As an alternative to tape and gauze, reusable fabric wraps are used in practice and sparring situations. However, the problem with the current solution is the width of the fabric and the material properties of fabric are uniform and cannot provide the softness and coverage of gauze at the same time as the thinner strips of non-stretch properties of tape that can fit into different areas of the hand. Thus, there is also a need for reusable, supportive hand wraps with properties similar to gauze and tape for use in combat sports.

SUMMARY

This disclosure provides an improved closure system for closing various articles or supporting various joints. This integrated solution provides an improved lacing system and improved supportive wrap. The an article lacing system comprises an opening and closing section comprising a first side and a second side; a first set of eyelets on the first side; a second set of eyelets on the second side; lace looped through the first set of eyelets and the second set of eyelets; a pull point for tightening the lace, wherein the pull point is configured to simultaneously tighten all of the lace loops when pulled, thereby closing the opening and closing section; and a locking mechanism operably connected to the pull point, wherein the locking mechanism is configured to maintain the tension created when the pull point tightens the lace loops. In some embodiments, the article is a glove. In other embodiments, the article is footwear. In still other embodiments, the article is body-worn equipment.

In some embodiments, the article closure system further comprises a lace-strap operably connected to the pull point and comprising the locking mechanism. In some embodiments, the lace-strap comprises silicone arranged in a pattern to inhibit slippage of the lace-strap when the article lacing system is closed.

In another aspect, this disclosure provides a boxing glove comprising a lace closing system comprising: a volar wrist portion comprising volar eyelets; a dorsal wrist portion comprising dorsal eyelets; a pull point for tightening lace, wherein the pull point is configured to tighten the lace by being pulled, thereby closing the volar wrist portion and dorsal wrist portion; lace looped through the eyelets of the volar eyelets and the dorsal eyelets and through the pull point; and a locking mechanism operably connected to the pull point, wherein the locking mechanism is configured to maintain the tension created when the pull point tightens the lace loops. In some embodiments, the boxing glove comprises a lace-strap operably connected to the pull point and comprising the locking mechanism. In some embodiments, the boxing glove the lace-strap comprises silicone arranged in a pattern to inhibit slippage of the lace-strap when the article lacing system is closed.

In yet another aspect, this disclosure provides a method of closing an article, comprising: looping lace through a first set of eyelets on a first side of an opening and closing section and a second set of eyelets on a second side of an opening and closing section, wherein the lace is looped so that a single pull point can tighten all of the lace simultaneously; pulling the pull point to tighten all of the lace, thereby closing the opening and closing section; and engaging a locking mechanism to maintain the tightened state created by the pulling of the point.

In still another embodiment, this disclosure provides a handwrap for combat sports, comprising: a first material for impact dissipation, wherein the first material is designed for wrapping around a user's hand; non-stretchable webbing connected to the first material comprising a non-slip coating arranged to inhibit slippage of the handwrap and comprising a locking mechanism configured to lock the handwrap in a tightened configuration, wherein the webbing is designed to wrap around the first material and provide support to the user's hand, wherein the webbing is about half as wide as the first material. In some embodiment, the non-slip coating comprises silicone. In some embodiments, the silicone is arranged in a pattern. In some embodiments, wherein the first material has a width of about two inches and the webbing has a width of about one inch.

In another aspect, this disclosure provides a lace-converter strap system configured to attach to an article comprising a lace-system and to tighten the lace system, comprising a length of webbing comprising: an attachment end configured to receive and pull a lace; a tightening end opposite the attachment end comprising a locking mechanism; and a non-slip coating. In some embodiments, the attachment end comprises a loop. In some embodiments, the lace-converter system is configured to connect to a boxing glove.

This disclosure also provides a reusable-tape alternative comprised of a thinner woven webbing with a non-slip treatment on one side attached at the end to act similar to tape when supporting the hand. The reusable-tape alternative attaches to any hook and loop compatible support wraps. In some embodiments, the reusable tape-alternative comprises hook and loop material for securing a closed position.

Another aspect of this disclosure provides a reusable tape alternative separate from the material that wraps around a user's hand. In some embodiments, the reusable tape alternative comprise non-stretchable material designed to wrap around a handwrap that is wrapped around a user's hand. In some embodiments, the reusable tape alternative comprises portions of silicone on the side of the tape configured to contact the handwrap. In some embodiments, the silicone is arranged in a pattern.

DETAILED DESCRIPTION

Figure 1:
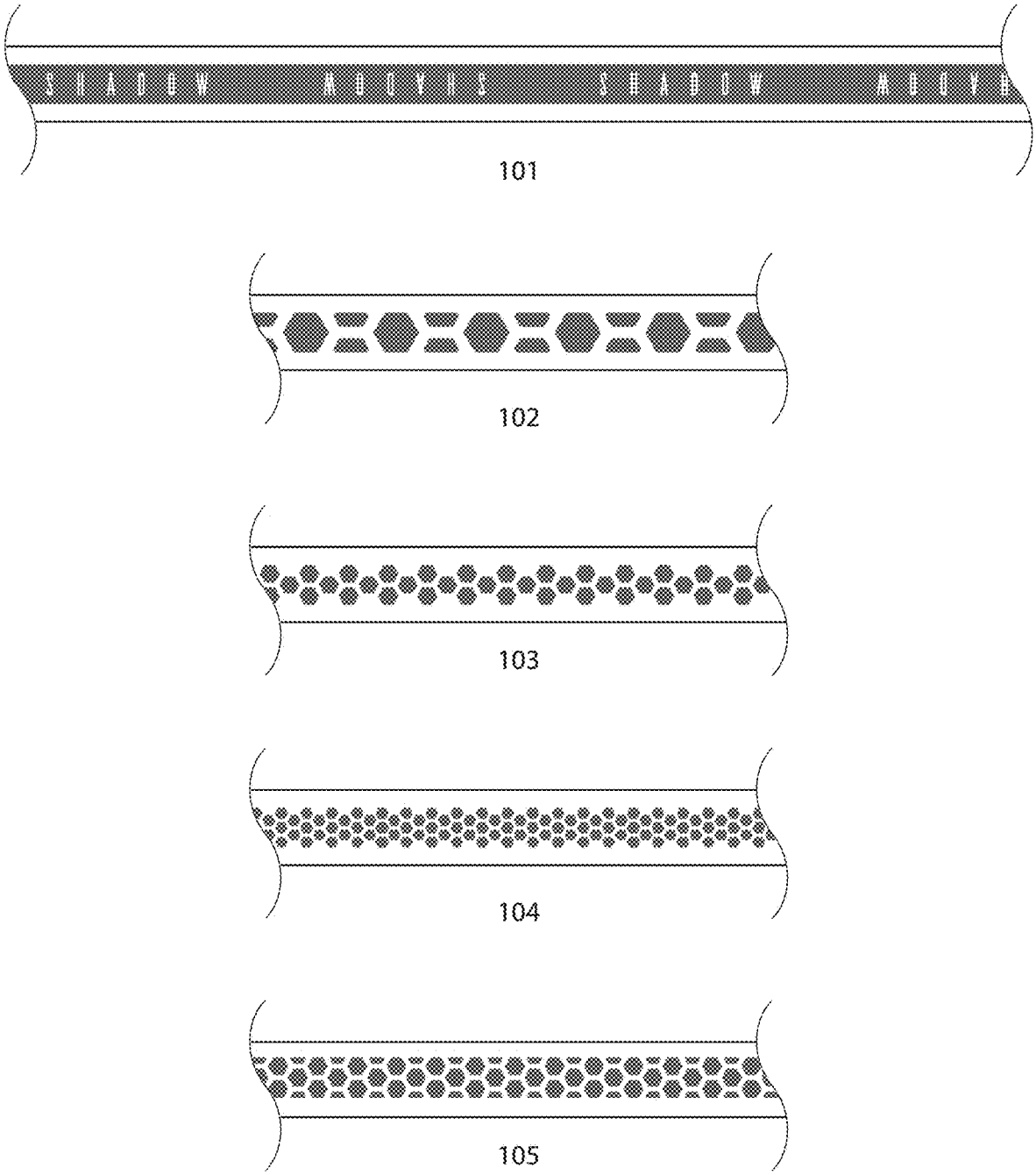
FIG. 1 shows non-slip silicone arranged in patterns on non-stretch webbing.

The closure system disclosed herein provides an alternative or modified solution to lacing systems for footwear, gloves, body-worn equipment, and other equipment that provides an open and closed state. Generally, an open state is a relaxed or loosened configuration to allow appendages or materials to be inserted into the object (e.g., a shoe untied to allow a foot to enter). The closed state generally describes the tightened, secure, or fastened state of the object (e.g., a shoe tied on a foot). The closure systems disclosed herein can also be used with any closed loop articles such as belts, support brace, vests, or corsets, with carriage systems such as bags, and with outdoor applications such as tents or hammocks.

The closure system comprises an object to be closed, an eyelet system which acts as a pulley, lace, a pull point, and a locking mechanism. In some embodiments, the pull point and locking mechanism are combined in one mechanism. In various embodiments, the object to be closed is a glove, boot, belt, or another piece of body-worn equipment. In some embodiments, the object comprises a closed looped configuration such as a shoe that is pre-laced, slipped on, and tightened. In other embodiments, the object comprises an open loop configuration such as a belt that is open until fastened. The eyelet system describes the holes through the object. The lace passes through the eyelet system. In some embodiments, the eyelets are simple holes punched through the material of the object such as holes punched through leather shoes for laces. In other embodiments, the eyelets comprise a manufactured secondary part such as a molded or stamped ring that can be mounted on the object to help create a friction or slip-surface for the lace to move through. The cross-sectional geometry of the through-holes on the eyelet aid in redirecting the force lines applied by the lace.

The lace is an object woven through the eyelets in a specific order to allow one point of pulling to evenly close the span of the system. In some embodiments, the lace comprises traditional woven fabric, leather, metal, wire, or combinations thereof. In some embodiments, one lace is needed per closure section. However, multiple sections of an object can be combined to close an entire object. For example, a boot could have multiple closing sections for the top of foot, for the ankle, and for the calf area. The pull point is the location and apparatus that captures all lace loops and is configured to tighten the lace when pulled. The pull point is the endpoint of all the redirected force lines. In some embodiments, the pull point is molded or sewn. The pull point is generally attached to a locking mechanism to secure the closure created by the tension in the lace by pulling the pull point. One example of a locking mechanism is a strap comprising Velcro™ (i.e., hook-and-loop material) which secures through sheer force. Other embodiments of locking mechanisms include a non-slip coating such as silicone applied to a webbing strap, plastic or metal buckles like a quick disconnect, pin and grommet, wedge (stake), knotting, and button closures.

In one embodiment, the object to be closed by a closure system is a boxing glove. The glove comprises a closed-loop configuration when the glove is laced. The lace is woven through in a specific order to create lace loops captured by a pull point. The pull point is configured to evenly pull and tighten or cinch the lace, thereby closing the glove opening. This configuration allows a user to quickly and evenly tighten the boxing glove on the user's inserted hand. In some embodiments, the pull point is connected to a strap comprising hook-and-loop material (e.g., Velcro) that is configured to lock the closure system of the glove in a closed or tightened position. In alternative embodiments, the pull point is connected to a locking mechanism comprising plastic release buckles or buttons instead of hook-and-loop material.

This disclosure also provides a lace-converter strap system for multiple styles of use for boxing gloves. In some embodiments, the strap system comprises a length of fabric or fabric-like material such as leather, webbing, or ribbon (stretch or non-stretch). Webbing refers to woven fabric and includes ribbon, tape, and similar woven fabrics. The lace-converter strap system comprises an attachment end configured to connect the lace-converter strap system to a boxing glove having a lacing system. In some embodiments, the attachment end comprises loop material. The lace-converter strap system comprises a tightening end opposite the attachment end that comprises hook material configured to engage on to the loop material of the attachment end when the lace-converter strap system is wrapped around a boxing glove. In alternative embodiments, the attachment end comprises hook material and the tightening end comprises loop material. In some embodiments, the attachment end comprises a webbing loop for lacing to go through, or holes for lacing to go through, or both. The webbing loop allows the lace to pass through and to be pulled in one direction for closure of the glove. After pulling the loop, the strap is looped around the glove to tighten and secure the lacing of the boxing glove in a tightened position. In some embodiments, the strap comprises a non-slip silicone layer to help ensure grip of the closed loop.

Figure 7:
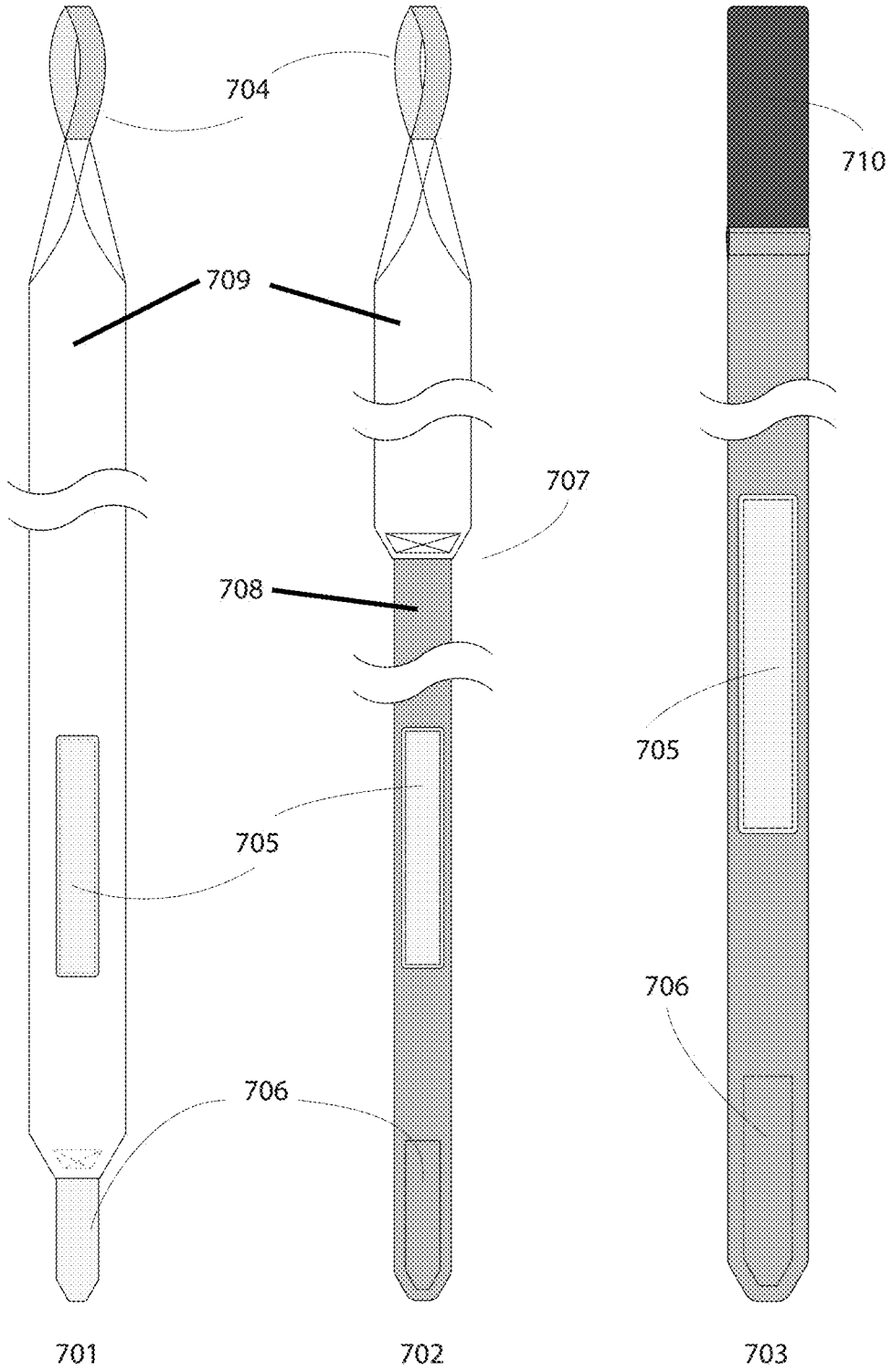
FIG. 7 shows variations of handwraps, including a sewn-on non-slip non-stretch and a detachable non-slip non-stretch webbing tape-alternative configuration.

In another embodiment, the strap attachment end comprises holes for anchoring the lace to the strap. The boxing glove can then be laced as normal. The strap can be used to cover the knot of the lace tied to the strap or tied under the strap in order to prevent injury or untying and provide a secondary tightening system (as shown in FIG. 7). In other embodiments, the strap can is used as the primary closure system by affixing it to the glove using a lace through multiple holes (as described in FIG. 8).

Turning now to the figures, FIG. 1 shows variations of a non-slip silicone pattern bonded to non-stretch woven webbing tape-alternative (also referred to as the "lace-strap"). 101 shows an exemplary silicone written pattern used on the lace-strap system. 102-105 depict alternative silicone patterns that can be used for the lace-strap system. Other patterns not shown include stripes, lines, and other geometric shapes.

Figure 2:
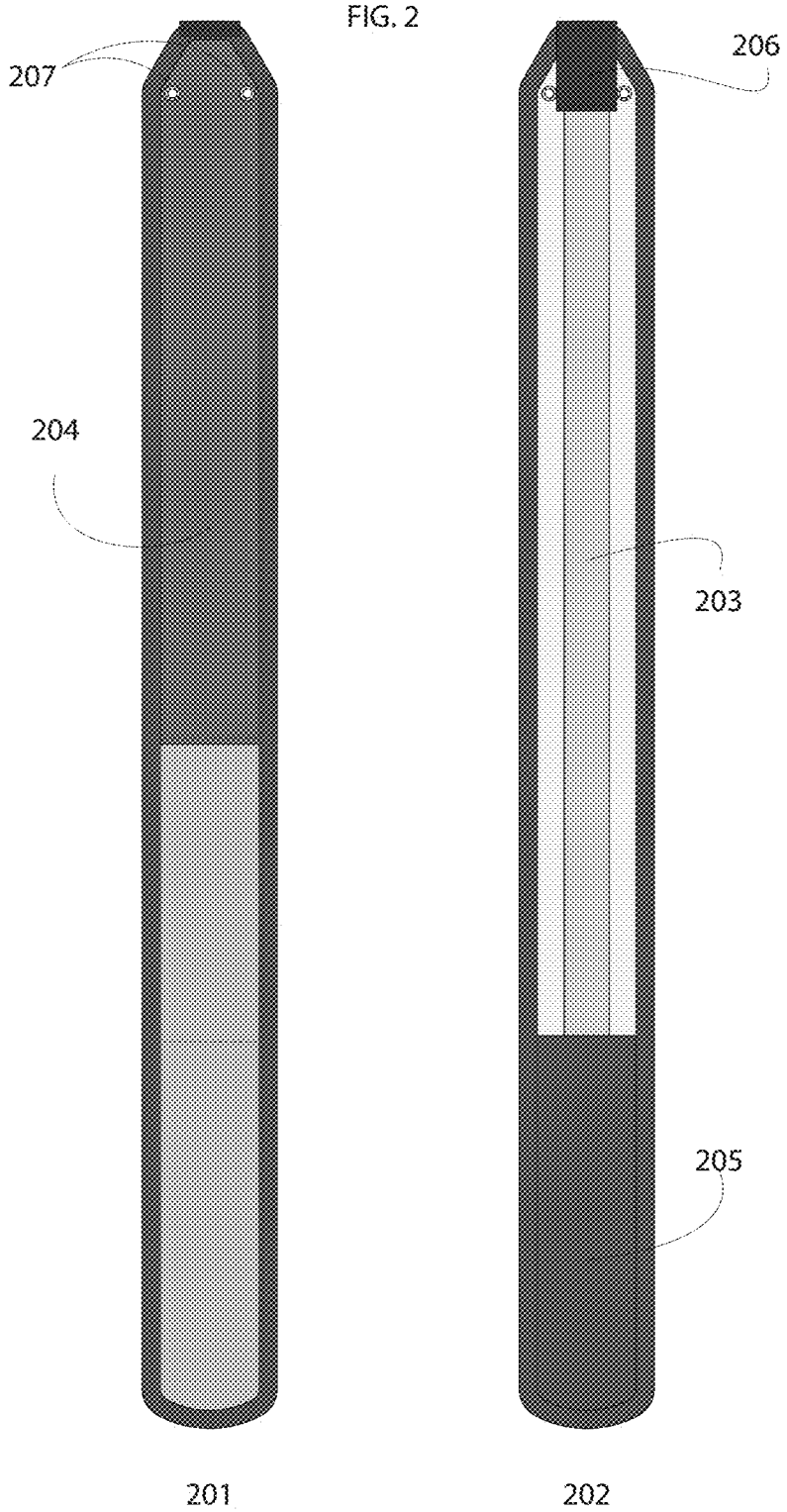
FIG. 2 is an illustration of both sides of a lace-strap of this disclosure.

FIG. 2 shows the lace-strap system without the glove. 201 is the outside facing side of the strap. 204 is a section of hook-compatible loop material. The lace-strap system comprises leather or another soft fabric. 207 refers to holes available for alternative means of using the lace strap with other gloves and glove types. 202 shows the inside facing side of the lace-strap. 205 depicts the loop-compatible hook. 203 depicts non-slip silicone bonded to the non-stretch webbing (in this case, the silicone is arranged as a stripe down the center). 206 depicts a second section of non-stretch webbing configured as a loop to gather laces and act as the pull point. The strap is intended to be pulled tight, as the loop depicted in 206 pulls on multiple portions of the lacing at the same time.

Figure 3:
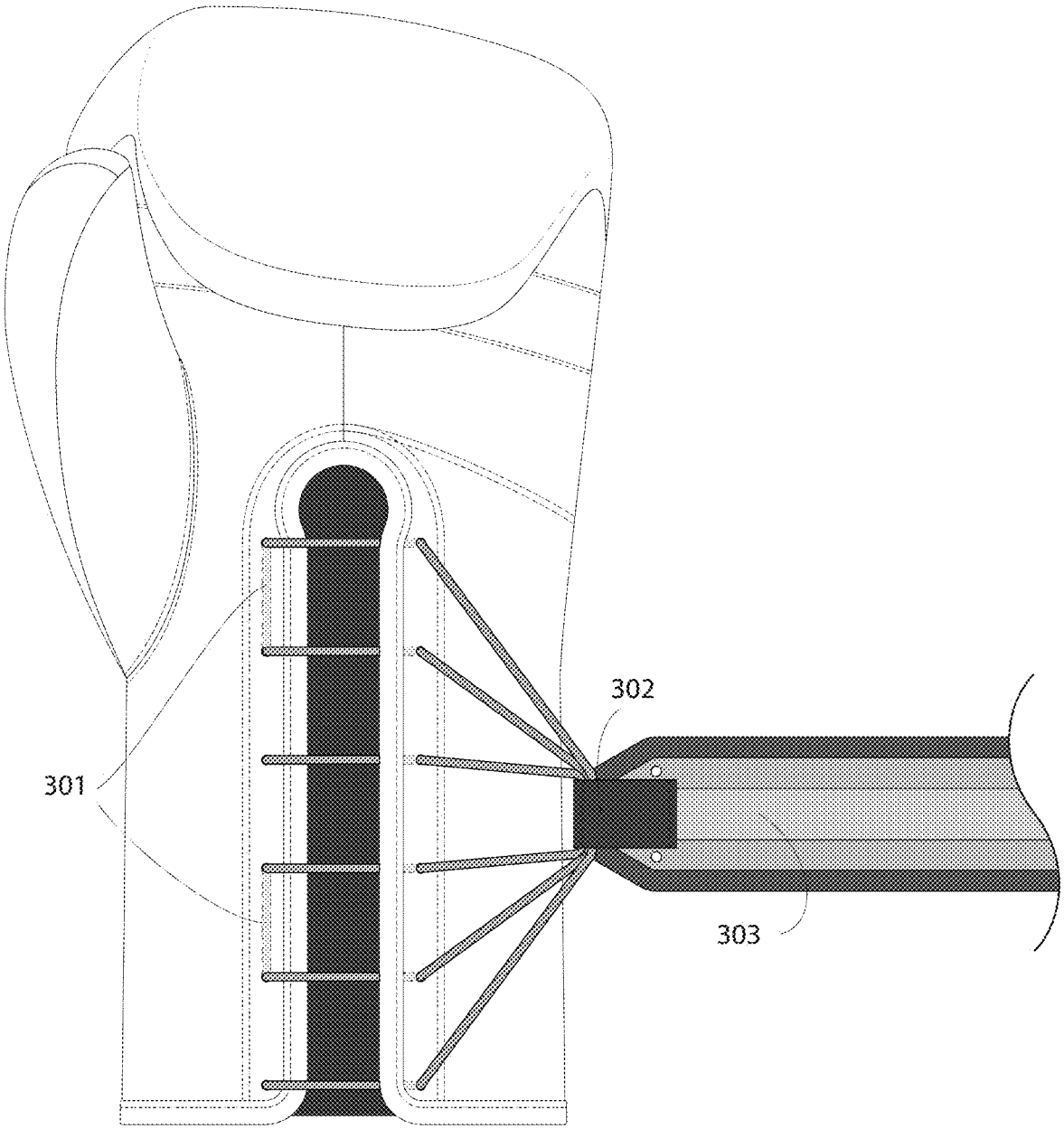
FIG. 3 shows an open glove with the lace of the glove connected to the lace-strap.

FIG. 3 is a representative view of an embodiment of a boxing glove comprising the closure system. 301 show a hidden-line path of the lace underneath the glove material. 302 is the location where the lace is gathered at a pull point where force can be applied to pull and tighten the system (as illustrated by 206 in FIG. 2). 303 shows the non-slip silicone pattern on the lace-strap that will grip on to the leather of the glove and inhibit slippage when the lace-strap is pulled and wrapped around the glove. The silicone pattern acts inhibits slippage and helps maintain the tension of a wrapped glove in a closed or tightened position.

Figure 4:
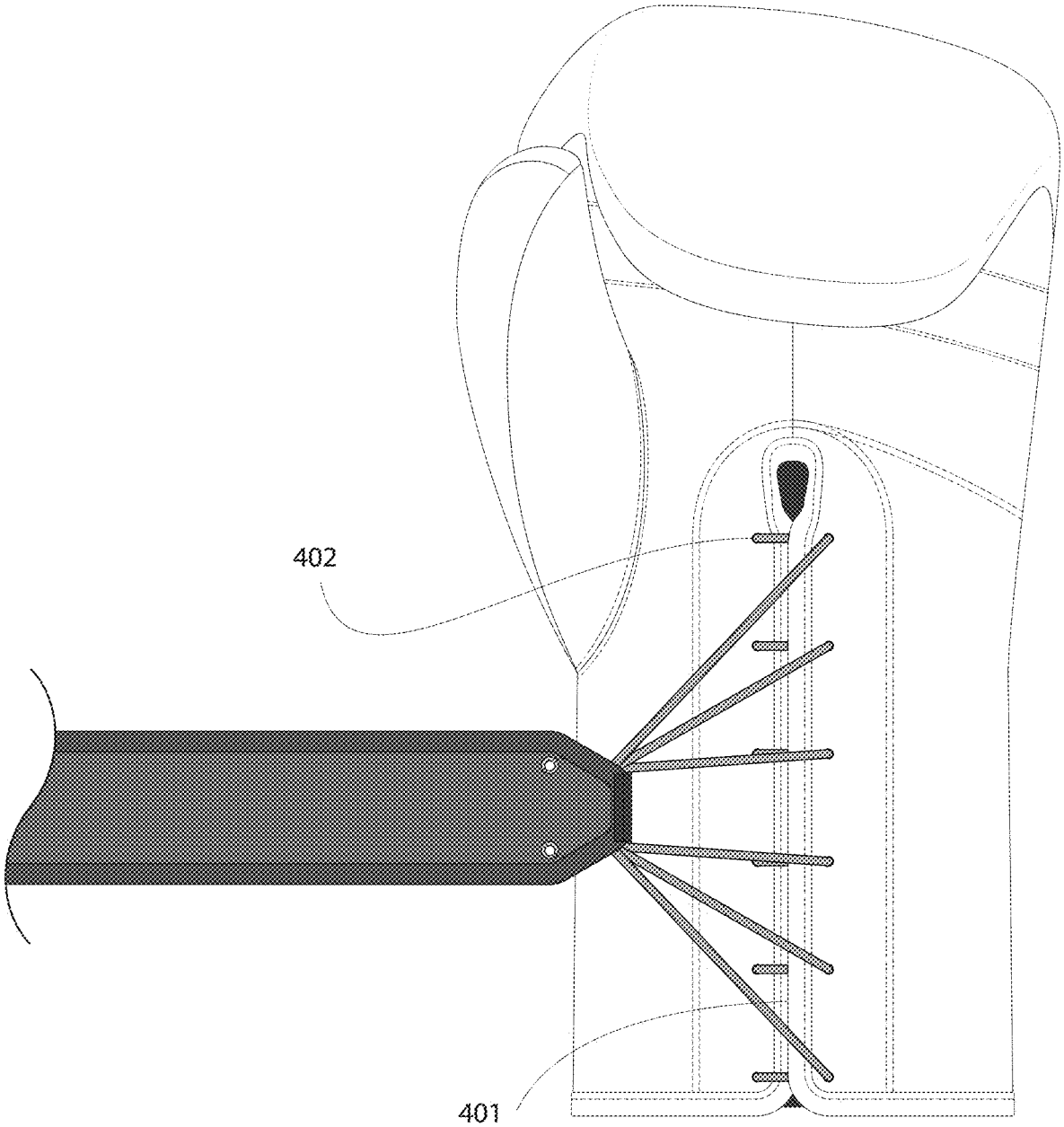
FIG. 4 shows a glove with its lace portion tightened to close the glove.

FIG. 4 shows a tightened glove in accordance with an embodiment. The overlap of material made possible by lacing 401 maximizes closure of the glove. Horizontal force lines 402 enable uniform closing of the system when the pull point is pulled.

Figure 5:
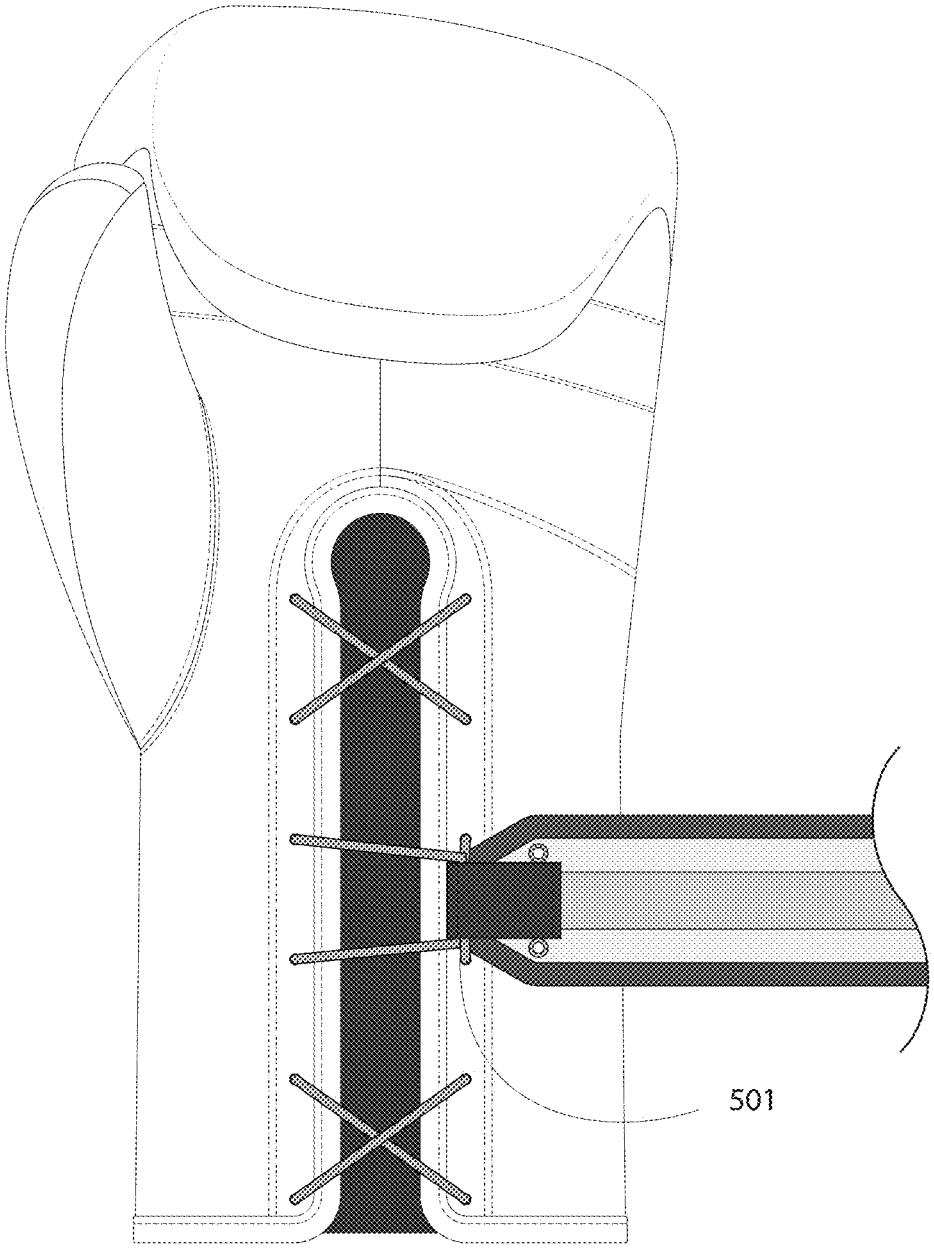
FIG. 5 shows another embodiment of use of the lace-strap with lacing of a boxing glove.

FIG. 5 shows an alternative embodiment of the lace-strap system. In this embodiment, the lace passes through the loop of lace-strap 501 to secure the strap on to the glove. The glove can be laced and tied. Once laced and tied, the strap can be used to cover the knot of the lace to prevent untying during use, and injury to the users.

Figure 6:
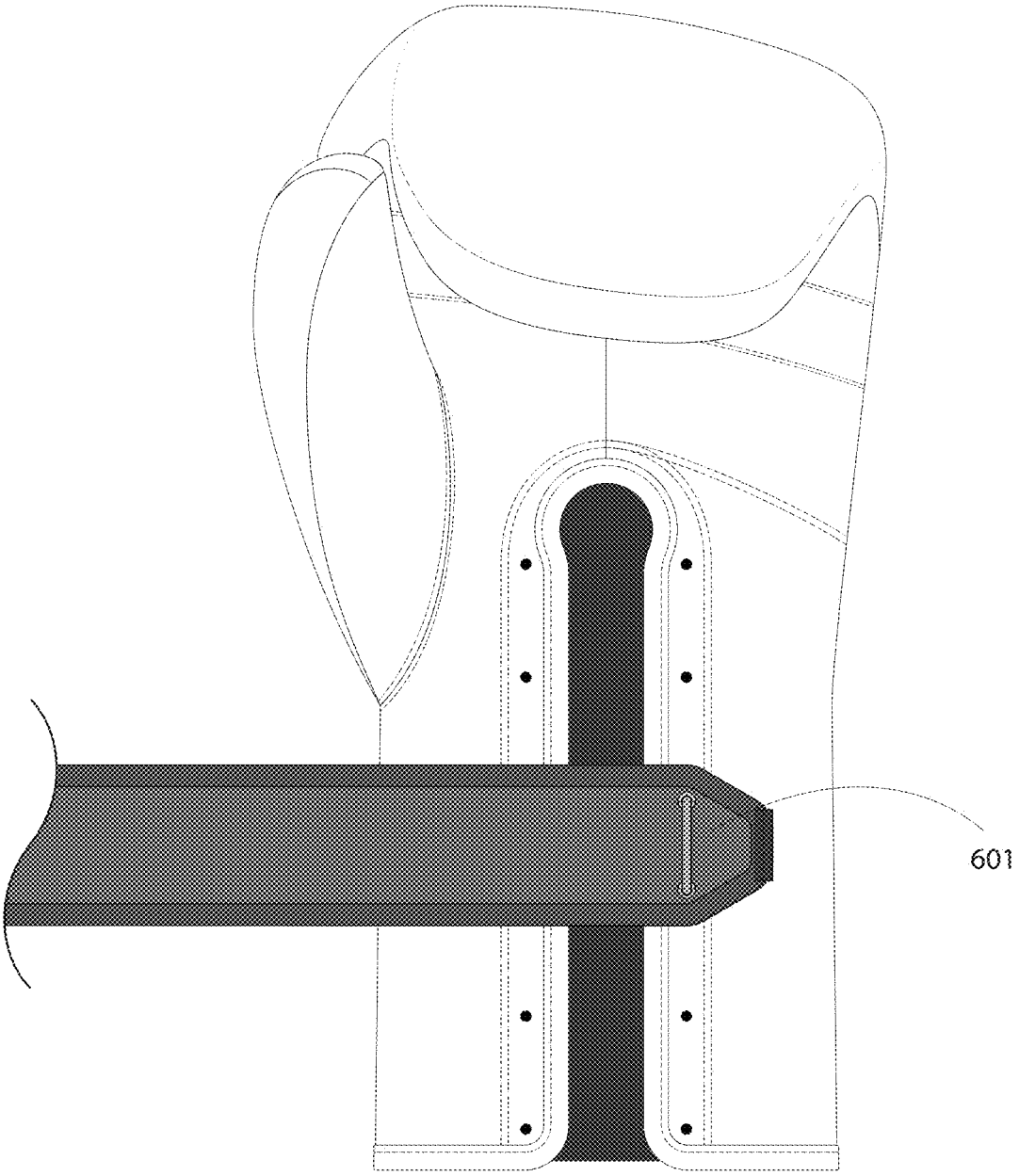
FIG. 6 shows a variation of a strap used to convert laced gloves into strap-only gloves.

FIG. 6 shows another alternative embodiment of the lace-strap system. In this embodiment, one lace would proceed through two holes of strap 601 to replace lacing all together. This alternative use would convert lace-gloves into strap-only gloves.

This disclosure also provides a dual-material hand wrap that is a multiple use solution for supporting the wrist and hand for combat sports. Customarily, the best way to support the hand has been with gauze and tape applied by a skilled technician or licensed cornerperson. Certain sport regulations require tape and gauze for competition. Typically, 2-inch width gauze is used to conform to the hand and create a layer of soft padding. The gauze is also used to dissipate the impact from striking and provide a protective layer between the skin and tape. After the gauze is applied, a trainer or skilled technician uses tape, typically thinner in the width than gauze and often 1-inch in width, to build a structure around the gauze to support the hand. The tape is stiffer than gauze and provides support.

After a training session or fighting match, the tape/gauze structure is cut off the hand and discarded. The tape and gauze can only be used once. After being removed from the user's hands, the tape and gauze are no longer useable and must be discarded. This single-use feature of the tape/gauze is wasteful. Moreover, some combat sport regulations require four rolls of gauze and two rolls of tape for each combatant. This is a large waste of material. Additionally, the tape/gauze method of supporting the hand is problematic for everyday use because it is time-consuming to wrap a person's hands with tape and gauze. Furthermore, it is very difficult to apply to oneself, and typically requires another (skilled) person to do so. Although tape and gauze are the best current way to support the hand, there are many drawbacks to the tape/gauze combination for combat bouts and for everyday training.

Another current solution for training in combat sports involves using "velpeau" fabric hand wraps that typically come in uniform widths with varying lengths (e.g., 120 inches, 180 inches) with thumb loops to attach and hook/loop closures to secure. The fabric hand wraps provide a quick-to-apply, reusable solution to everyday training that users can apply by themselves. However, there are multiple drawbacks with the fabric hand wraps. For one, the fabric is used to replace the soft conformal gauze and the more structured tight tape. When applying tape/gauze, the tension can be controlled through using the two different materials. This is not as controllable with velpeau or other fabric hand wrap solutions. For example, if the applicator wraps the fabric too tightly, there is a risk of cutting off circulation. Alternatively, if the fabric is wrapped too loosely, there is no support for the hand and there is no structure to the wrap. Furthermore, most users are inexperienced and wrap either too tight or too loose.

This disclosure provides reusable handwraps comprising multiple materials with differing properties to mimic the impact and support properties of the tape/gauze solution. In one aspect, this disclosure provides handwraps comprising a fabric hand wrap, typically about 2 inches in width, and a thinner-width non-stretch non-slip woven webbing sewn to the end. The non-stretch non-slip webbing piece is also referred to herein as a reusable tape-alternative. During use, the layer of fabric is used to conform to the user's hand and build a soft padding layer. Then, the thin webbing is wrapped over the fabric to provide structural support and to close off the wrap. The handwraps of this disclosure comprise multiple materials with differing material properties and a variance in width to create a quick, reusable solution that increases support and impact dissipation compared to the current standard reusable wrap and when compared to the single-use tape/gauze solution.

The reusable tape alternative system is a separate material from the material that wraps around a user's hand. In some embodiments, the reusable tape alternative comprise non-stretch webbing material designed to wrap around the fabric handwrap that is wrapped around a user's hand. In some embodiments, the reusable tape-alternative comprises portions of silicone on the side of the webbing configured to contact the handwrap or the tape-alternative itself or both. In some embodiments, the silicone is arranged in patterns such as diamonds, lines, dots, spiral spray, random spray, continuous lines, circles, other geometric shapes, or combinations thereof. One end of the reusable tape-alternative secures itself to the handwrap using fabric comprising hook material on one side and loop material on the other side. The tape-alternative closes off using both hook and loop parts.

FIG. 7 shows three variations of handwrap systems. 701 is a boxing handwrap comprising thumb loop 704 to anchor the handwrap on to a user's thumb, and a length of fabric 709 to support the bones in the user's hand. Handwrap 701 closes on itself using hook material 706 and loop material 705. Handwrap 702 shows a sewn-in variation where a non-slip non-stretch webbing 708 is attached at 707 (e.g., is sewn) to fabric portion 709. Handwrap 702 comprises thumb loop 704, but also comprises the hook material 706 and loop material 705 sewn on to the non-stretch webbing. Handwrap 703 depicts the unattached reusable tape-alternative. This system shares a hook 706 and loop 705 closure like the sewn system (702). However, instead of a thumb loop, handwrap 703 attaches to an end of a traditional handwrap using a hook and loop compatible webbing 710 that comprises hook material on one side and loop material on the other to correspond to the matching hook or loop material of the end of the traditional handwrap.

Figure 8:
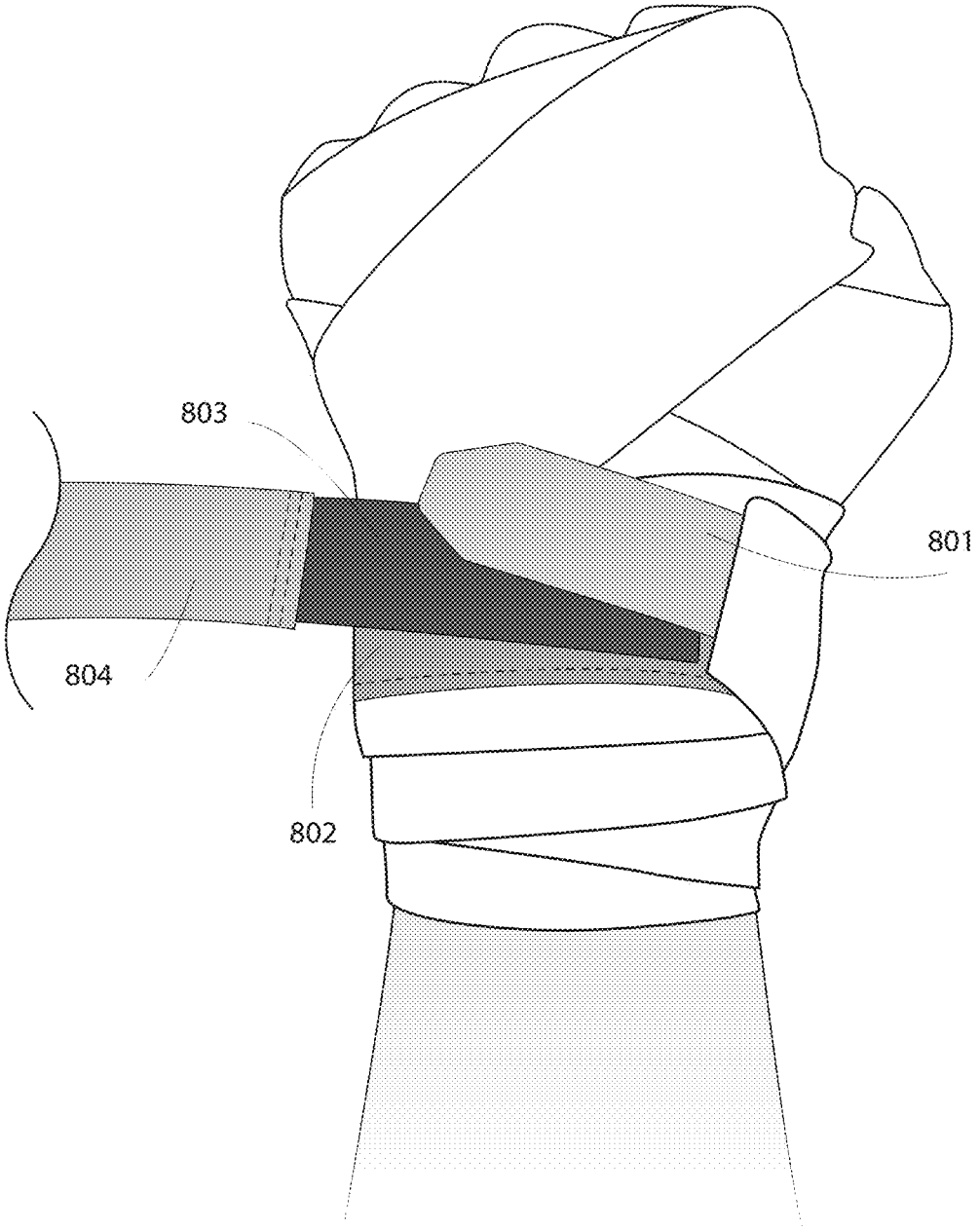
FIG. 8 shows a detachable non-stretch webbing tape-alternative attaching to the end of a fabric hand wrap using hook and loop material.

FIG. 8 shows a detachable non-stretch non-slip coated webbing connected to the end of a traditional handwrap by means of hook and loop compatible material sewn on the end of the webbing. The handwrap hook material 801 attaches to the loop material side of 803, while the hook material side of 803 (the underside in FIG. 8) attaches to the handwrap loop material 802 thereby securing the non-stretch non-slip tape alternative to the handwrap. The non-stretch non-slip coated webbing is sandwiched between the hook and loop material portions of the handwrap. The whole wrap can then be wrapped around the hand and anchored to itself using hook and loop again (as depicted by 705 and 706 from FIG. 7).

Figure 9:
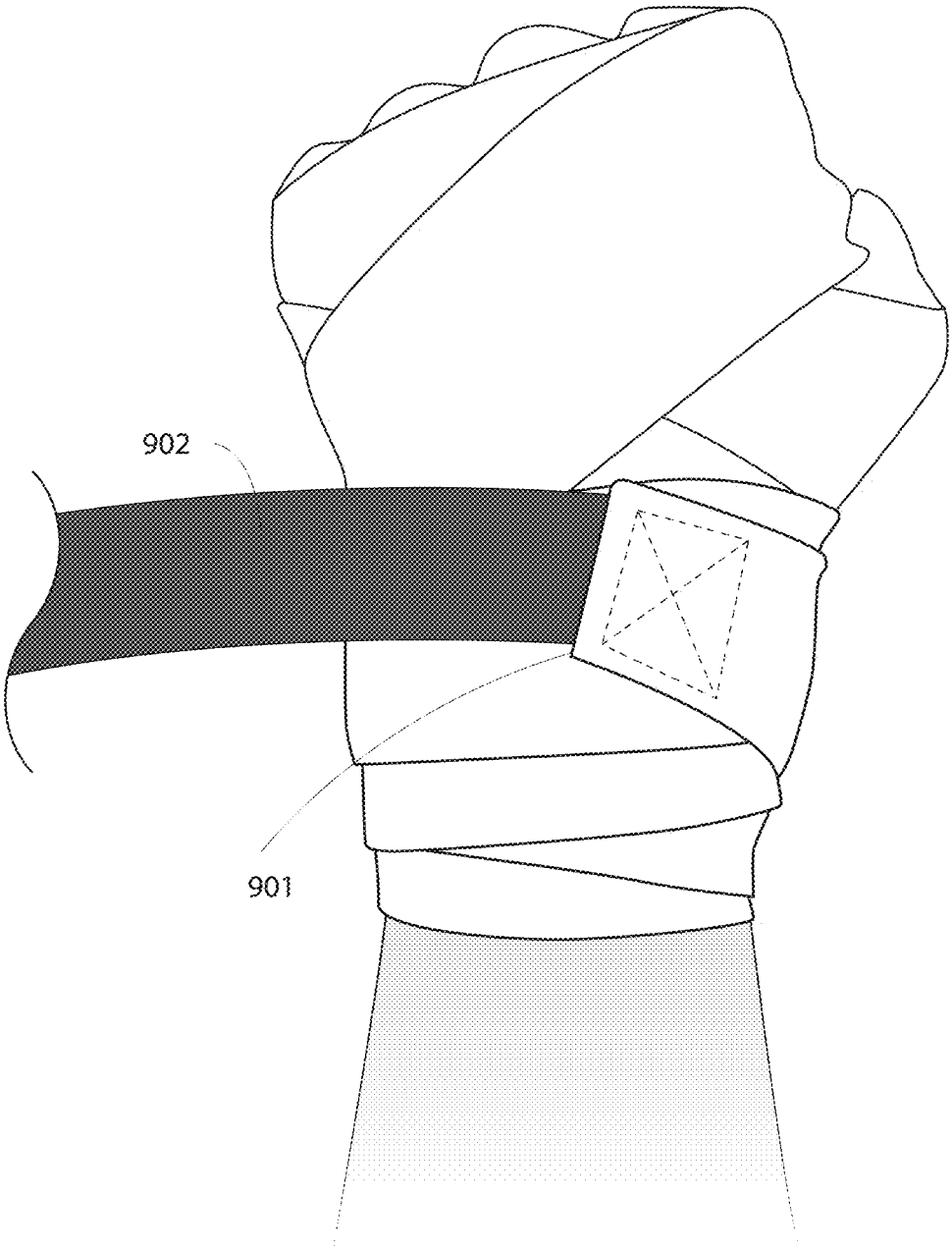
FIG. 9 shows the non-stretch webbing tape-alternative sewn to the end of a fabric handwrap.

FIG. 9 illustrates when all the fabric is wrapped around the hand, and the webbing section remains to be wrapped. When the fabric is wrapped, a thinner length of non-stretch webbing is sewn to the fabric as shown by 901. The webbing 902 then is wrapped around the hand to provide improved use, support, and motion of the hand. Webbing 902 can comprise hook-and-loop material and a non-slip coating such as silicone.

Figure 10:
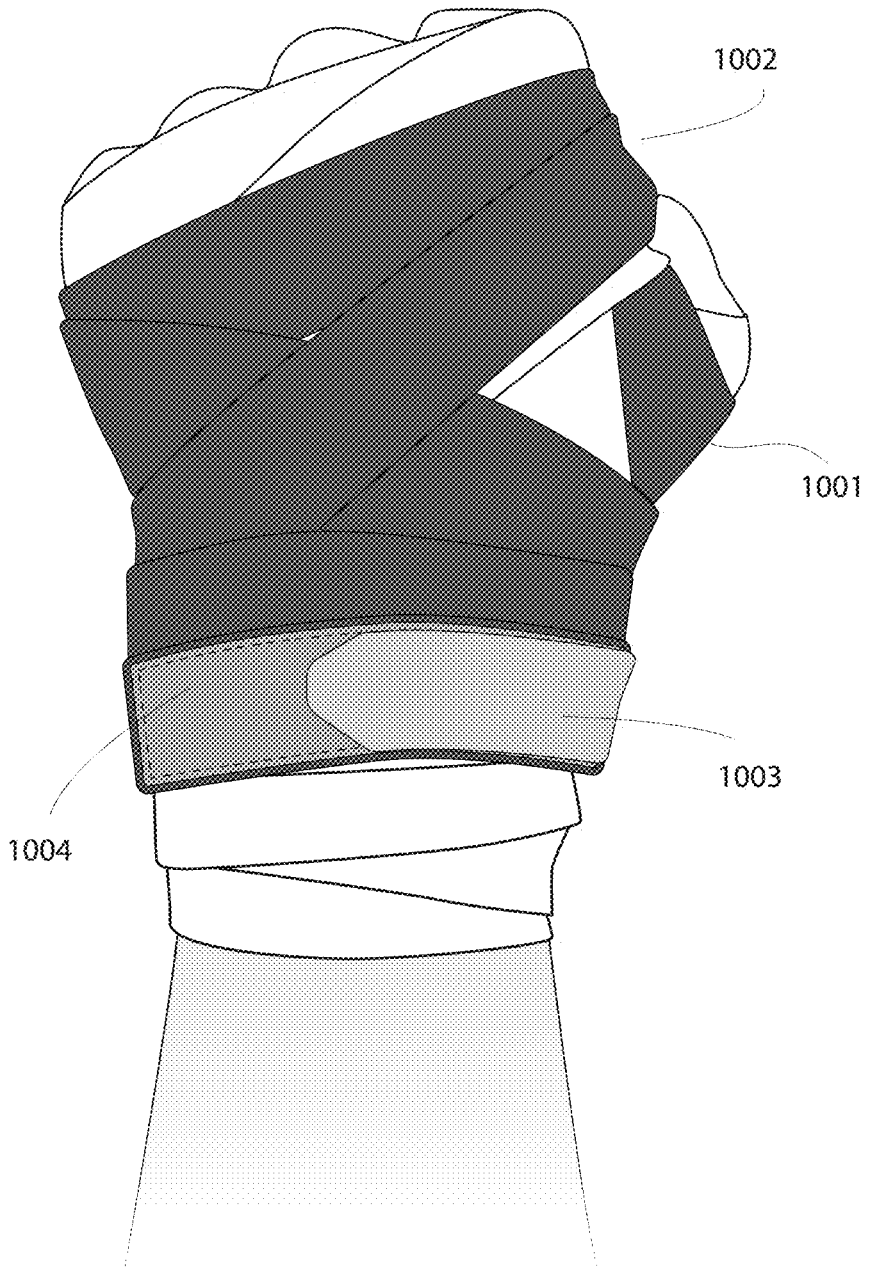
FIG. 10 shows the non-stretch non-slip webbing tape-alternative wrapping over the fabric portion of the handwrap to support the hand, and a hook and loop closure.

FIG. 10 shows the tape-alternative for the wrist for stability and bone support while punching. The non-slip non-stretch webbing is thinner in width than the fabric to ensure a better fit and support. A smaller width allows for a more secure wrap around thumb 1001 and to fit comfortably below the knuckles and between the bones of the wrist and hand 1002. The thinner tape alternative allows for a better fit when compared to the wider fabric. The system is then closed using a hook 1003 and loop 1004 mechanism.

The invention claimed is:

1. A combat sports glove comprising a lacing system, comprising:

an opening and closing section comprising a first side and a second side, wherein the first side and second side are configured to be pulled together to close the opening and closing section;

a first set of eyelets on the first side;

a second set of eyelets on the second side;

lace passed through the first set of eyelets and the second set of eyelets; and a strap comprising:

a pull point configured to evenly tighten a plurality of sections of the lace, thereby evenly pulling together the first side and second side, and configured to be pulled parallel to the direction of the closing of the first side and the second side;

a locking mechanism configured to maintain tension when the pull point tightens the lace, and silicone arranged in a pattern to inhibit slippage of the strap when the lacing system is tightened.

2. A handwrap for combat sports, comprising:

a first material for impact dissipation, wherein the first material is designed for wrapping around a user's hand;

non-stretchable webbing connected to the first material comprising a non-slip coating arranged to inhibit slippage of the handwrap and comprising a locking mechanism configured to lock the handwrap in a tightened configuration, wherein the webbing is designed to wrap around the first material and provide support to the user's hand, wherein the webbing is about half as wide as the first material.

3. The handwrap of claim 2, wherein the non-slip coating comprises silicone.

4. A lace-converter strap system configured to attach to a boxing glove comprising a lace-system and to tighten the lace system, comprising:

a length of webbing comprising:

a first end comprising a webbing loop configured to receive and pull a lace;

a second end opposite the first end comprising a locking mechanism; and silicone arranged in a pattern to inhibit slippage of the webbing.

* * * * *